US005770551A

United States Patent [19]

Block et al.

[11] Patent Number: 5,770,551

[45] Date of Patent: Jun. 23, 1998

[54] AMIDO- AND IMIDO-PEROXYCARBOXYLIC ACID BLEACH GRANULES

[75] Inventors: Philip Alan Block, North Bergen; Samuel Qcheng Lin, Paramus; Robert Madeira Andrews, Oakland; Scott David Manske, Ridgfeield, all of N.J.

[73] Assignee: Lever Brothers Company, Division of Conopco, Inc., New York, N.Y.

[21] Appl. No.: 699,314

[22] Filed: Aug. 19, 1996

[51] Int. Cl.[6] ..... C11D 7/18

[52] U.S. Cl. ..... 510/310; 510/375; 510/376; 252/186.26; 252/186.42

[58] Field of Search ..... 510/310, 375, 510/376; 8/111; 252/186.42, 186.26

[56] References Cited

U.S. PATENT DOCUMENTS

| | | | |
|---|---|---|---|
| 4,126,573 | 11/1978 | Johnston . | |
| 4,374,035 | 2/1983 | Bossau . | |
| 4,909,953 | 3/1990 | Sadlowski et al. . | |
| 5,049,298 | 9/1991 | Ploumen et al. . | |
| 5,055,218 | 10/1991 | Getty et al. | 510/310 |
| 5,098,598 | 3/1992 | Sankey et al. . | |
| 5,279,757 | 1/1994 | Gethöffer et al. | 510/310 |

FOREIGN PATENT DOCUMENTS

| | | |
|---|---|---|
| 0 450 587 | 10/1991 | European Pat. Off. . |
| 91/16411 | 10/1991 | WIPO . |
| 92/11238 | 7/1992 | WIPO . |
| 95/03276 | 2/1995 | WIPO . |

*Primary Examiner*—Margaret Einsmann
*Attorney, Agent, or Firm*—Milton L. Honig

[57] ABSTRACT

A bleach granule is provided with 60–100% being an intimate mixture of an amido or imido $C_2$–$C_{30}$ peroxy acid and a surfactant, in a weight ratio of 20:1 to 1:20. The most preferred peroxyacids are N,N-phthaloylaminoperoxycaproic acid (PAP); monononylamide of either peroxysuccinic acid (NAPSA) or peroxyadipic acid (NAPAA) and N,N'-terephthaloyl-di(6-aminoperoxycaproic acid) (TPCAP). Localized dye damage from the peroxy acid bleach is prevented by the presence of the surfactant. Bleach compositions and a method for cleaning a stained substrate with the bleach granule are also described.

2 Claims, No Drawings

AMIDO- AND IMIDO-PEROXYCARBOXYLIC ACID BLEACH GRANULES

BACKGROUND OF THE INVENTION

1. Field of the Invention

The invention concerns bleach granules, compositions and a method for cleaning colored fabrics without causing localized dye damage.

2. The Related Art

Peroxyacid granulation has been the subject of much research. The literature has described a variety of ways to improve chemical stability, prolong storage life and enhance releasability.

U.S. Pat. No. 5,049,298 (Ploumen et al.) inhibits peroxyacid decomposition through co-granulation with a hydratable inorganic material. Diperoxydodecanedioic acid ("DPDA") and N,N-phthaloylaminoperoxycaproic acid ("PAP") are typical of the peroxyacids. These are granulated with sodium sulphate, the preferred hydratable inorganic material. Binders such as lauric acid or sodium dodecylbenzene sulphonate ("LAS") are added to enhance cohesiveness. U.S. Pat. No. 4,909,953 (Sadlowski et al.) stabilizes amidoperoxyacids, especially the monononylamide of peroxysuccinic acid ("NAPSA") and the monononylamide of peroxyadipic acid ("NAPAA") by contact with a phosphate buffer solution. A related disclosure is U.S. Pat. No. 5,055,218 (Getty et al.) which describes bleach granules of NAPAA and linear alkyl benzene sulfonate paste. U.S. Pat. No. 4,126,573 (Johnston) reports avoidance of fabric dye damage by forming granules having a peroxyacid particle as an inner core surrounded by an outer coating of a surfactant compound. The process involves dissolving a surfactant such as LAS in water followed by dispersing finely divided DPDA and subsequent drying of the mixture.

Clearly this technology area is crowded for reasons that small process or formulation changes can have significant impact upon the resultant bleach particles. Most of the related art has focused upon stabilizing peroxy acid against decomposition. Relatively little attention has been given to the equally serious problem of localized dye damage.

Amido- and imidoperoxy acids are generally more storage stable than their equivalent non-nitrogen containing analogues. However they do suffer from the localized dye damage problem. The problem occurs during hand or machine washing when high concentrations of dissolved peracid come into contact with fabric surfaces prior to agitation. Previous attempts to control the problem through particle size and co-granulated/binder systems have generally been unsuccessful.

Accordingly, it is an object of the present invention to provide bleach granules, compositions and a method employing amido- and imidoperoxycarboxylic acids for cleaning stains that overcome the localized dye damage problem.

It is another object of the present invention to provide amido- and imidoperoxycarboxylic acid containing bleach granules that not only can avoid localized dye damage but are also rapidly releasable in wash media so they can be quickly active against stains.

These and other objects of the present invention will become more apparent by consideration of the following summary, detailed description and examples.

SUMMARY OF THE INVENTION

Now it has been discovered that localized dye damage can be averted by intimately dry mixing of amido- or imidoperoxy acid particles with a surfactant to form a bleach granule. More specifically, the invention provides:

A bleach granule including from 20 to 100% by weight of an intimate mixture of:

(i) an amido or imido $C_4$–$C_{30}$ peroxycarboxylic acid; and (ii) a surfactant, the peroxycarboxylic acid and surfactant being present in a weight ratio from 20:0 to 1:20.

A bleach composition including:

(a) from 0.5 to 30% by weight of a bleach granule including from 20 to 100% by weight of an intimate mixture of:

(i) an amido or imido $C_4$–$C_{30}$ peroxycarboxylic acid; and (ii) a surfactant, the peroxycarboxylic acid and surfactant being present in a weight ratio from 20:1 to 1:20; and (b) from 1 to 80% by weight of a builder.

A method is also provided for bleaching a stained substrate, the method including contacting the stained substrate in an aqueous medium with a bleach granule formed from 60 to 100% by weight of an intimate mixture of an amido or imido $C_4$–$C_{30}$ peroxycarboxylic acid and a surfactant, the peroxycarboxylic acid and surfactant being dosed into a weight ratio from 20:1 to 1:20, the bleach granule being dosed into the aqueous medium to provide peroxycarboxylic acid at a level from 0.05 to 100 ppm active oxygen.

A method for preparing a bleach granule is also provided involving the steps of:

(i) intimately mixing an amido- or imidoperoxycarboxylic acid and a surfactant to form a granulated mixture;

(ii) optionally combining with the mixture from 0.1 to 80% of a granulate adjunct, the ratio of peroxycarboxylic acid to surfactant ranging from 20:1 to 1:20 and the mixture constituting from 20 to 100% by weight of the granule.

The process is best performed either in the absence or with relatively small amounts of water. These amounts will usually be less than the combined amounts of peroxycarboxylic acid and surfactant, most especially amounts less than 15% by weight.

DETAILED DESCRIPTION

Peroxyacids of the present invention may be selected from mono- or di- percarboxylic amido or imido acids. The mono-percarboxylic acids are of the general formula:

$$R(R^1N)_nC(NR^2)m-R^3-\overset{\overset{\displaystyle O}{\|}}{C}OOM \qquad (I)$$

wherein:

R is selected from the group consisting of $C_1$–$C_{16}$ alkyl, $C_1$–$C_{16}$ cycloalkyl and $C_6$–$C_{12}$ aryl radicals;

$R^1$ is selected from the group consisting of hydrogen, $C_1$–$C_{16}$ alkyl, $C_1$–$C_{16}$ cycloalkyl and $C_6$–$C_{12}$ aryl radicals;

$R^2$ is selected from the group consisting of hydrogen, $C_1$–$C_{16}$ alkyl, $C_1$–$C_{16}$ cycloalkyl and $C_6$–$C_{12}$ aryl radicals and a carbonyl radical that can form a ring together with R;

$R^3$ is selected from the group consisting of $C_1$–$C_{16}$ alkylene, $C_5$–$C_{12}$ cycloalkylene and $C_6$–$C_{12}$ arylene radicals;

n and m are integers whose sum is 1; and

M is selected from the group consisting of hydrogen, alkali metal, alkaline earth metal, ammonium and alkanolammonium cations and radicals.

The di-percarboxylic acids of the present invention may be of the general formula:

$$MOOCR^4(R^5N)_{n'}\overset{O}{\overset{\|}{C}}(NR^6)_{n''}-R^3-(R^6N)_m\overset{O}{\overset{\|}{C}}(NR^5)_{m'}R^4COOM \quad (II)$$

wherein:

$R^4$ is selected from the group consisting of $C_1$–$C_{12}$ alkylene, $C_5$–$C_{12}$ cycloalkylene, $C_6$–$C_{12}$ arylene and radical combinations thereof;

$R^5$ is selected from the group consisting of hydrogen, $C_1$–$C_{16}$ alkyl and $C_6$–$C_{12}$ aryl radicals and a carbonyl radical that can form a ring together with $R^3$;

$R^6$ is selected from the group consisting of hydrogen, $C_1$–$C_{16}$ alkyl and $C_6$–$C_{12}$ aryl radicals and a radical that can form a $C_3$–$C_{12}$ ring together with $R^3$;

$R^3$ is selected from the group consisting of $C_1$–$C_{12}$ alkylene, $C_5$–$C_{12}$ cycloalkylene and $C_6$–$C_{12}$ arylene radicals;

n' and n" each are an integer chosen such that the sum thereof is 1;

m' and m" each are an integer chosen such that the sum thereof is 1; and

M is selected from the group consisting of hydrogen, alkali metal, alkaline earth metal, ammonium and alkanolammonium cations and radicals.

The most preferred peroxyacids are N,N-phthaloylaminoperoxycaproic acid (PAP); monononylamide of either peroxysuccinic acid (NAPSA) or peroxyadipic acid (NAPAA); and N,N'-terephthaloyl-di(6-aminoperoxycaproic acid) (TPCAP).

Amounts of the amido or imido peroxycarboxylic acid in the granule may range from 25 to 95%, preferably from 40 to 80% by weight.

Intimately mixed with the amido or imido peroxyacids will be a surfactant to ensure against dye damage to colors on the cloth subjected to bleaching.

The surfactant may be naturally derived, such as soap or certain synthetic material selected from anionic, nonionic, amphoteric, zwitterionic, cationic actives and mixtures thereof. The total level of the surfactant in the granule may range up to 90% by weight, preferably being from 1% to 50%, most preferably from 8 to 20%.

Usually the synthetic anionic surfactants will be water-soluble alkali metal salts of organic sulfates and sulfonates having alkyl radicals containing from about 8 to about 22 carbon atoms, the term alkyl being used to include the alkyl portion of higher aryl radicals. The preferred anionic surfactants are sodium ($C_{11}$–$C_{15}$) alkylbenzene sulphonates and sodium ($C_{16}$–$C_{18}$) alkyl sulfates.

The acid form of sulfuric and sulfonic surfactants have proved effective. Illustrative is the linear secondary alkyl $C_{10}$–$C_{15}$ benzene sulfonic acid, found more effective than its sodium salt form.

Examples of suitable nonionic surfactants are the alkyl polyglucosides, fatty acid sugar amides (e.g. methyl glucamides) and $C_{18}$–$C_8$ alkyl di-$C_1$–$C_7$ alkyl tertiary amine oxides or $C_{18}$–$C_{12}$ fatty amidopropyl di-$C_1$–$C_7$ alkyl tertiary amine oxides, the amine oxides being preferred.

The ratio of peroxycarboxylic acid to surfactant will usually range from 20:1 to 1:20, preferably from 10:1 to 1:1, optimally from 2:1 to 7:1 by weight.

Bleach granulations of this invention may optionally contain at least one granulate adjunct such as a stabilizer, exotherm control agent or binder.

The stabilizers may be phosphate or phosphonate chelants (e.g. Dequest®) and ethylenediaminetetraacetic acid. Amounts of these materials may range from 0.1 to 20% by weight of the granule. Exotherm control agents may be included to prevent autodecomposition of the peroxyacid. Amounts of the exotherm control agent may range from 1 to 80% by weight. Suitable examples of such agents are boric acid, citric acid and hydrated inorganic salts (e.g. magnesium sulfate). In certain instances it is advantageous not to include hydrated inorganic salts such as sodium sulfate, at least in amounts limited to below 10% by weight.

Binders for the granule may be fatty acids (e.g. lauric acid), polyacrylates and mixtures of these. Amounts of binder may range from 0.1 to 10% by weight.

Bleach compositions of the present invention which incorporate the bleach granules will also include a builder. Builders may be selected from calcium sequestrant materials, precipitating materials, calcium ion-exchange materials and mixtures thereof. Illustrative are sodium or potassium tripolyphophosphate, sodium carbonate, sodium citrate, tartrate mono- and di- succinates, oxydisuccinate, crystalline or amorphous alumino silicates (i.e. zeolites) and mixtures thereof. Amounts of the builder may range from 1 to 80% by weight, preferably from 10 to 60%.

Fabrics and other stained substrates may be cleaned by dispersal of the bleach granule in an aqueous medium. The bleach granule should be dosed at levels to achieve peroxycarboxylic acid concentrations that range from 0.05 to 100 ppm, preferably from 2 to 50 ppm in the medium. The amount of builder may range from about 0.1 to 3.0 grams per liter of aqueous medium.

The following examples will more fully illustrate the embodiments of this invention. All parts, percentages and proportions referred to herein and in the appended claims are by weight unless otherwise illustrated.

EXAMPLE 1

A series of granules according to the present invention were prepared by mixing the peroxycarboxylic acid bleach known as PAP with dimethyl $C_{16}$ alkyl amine oxide. PAP was formulated at 50% while the level of amine oxide to PAP was varied in weight ratio. The granules further included approximately 1% binder (secondary alkane sulfonate and polyacrylic acid) with the remainder of the composition being citric acid.

A mixture of the bleach granule and a commercial detergent powder were placed at the center of a sulfur dye test cloth of either black or prune color. A piece of cotton ballast was rolled into a tube and placed on top of the bleach granules. The sides of the test cloth were then raised so that the granules sat within a valley of the test cloth, with the ballast cloth tube entrapping the granules. This bundle was then placed in the bottom of a terg-o-tometer pot, with the remaining pieces of ballast cloths placed on top. Water was slowly added to the pot. A soak period of 30 minutes at 25° C. was followed by 2 minutes of agitation (100 rpm). The target active oxygen level was 5 ppm. The test cloths were then rinsed and air dried. This test was meant to simulate entrapment of the bleach granule/detergent at the bottom of a hand wash bowl or in a washing machine. Wash conditions and materials are as outlined below.

Conditions:

25° C.
12 FH (3:1 Ca:Mg)
liquor to cloth 20:1
terg at 100 rpm

Materials:

sulfur dye test cloth (4"×4")

cotton ballast
0.6 g detergent base powder (1.2 g/L of wash liquor)
500 mL water
bleach granule (dosed to deliver 5 ppm active oxygen in the wash)

The reflectance of the dye damage monitor cloths was measured using the Colorgard System/05 (manufacturer: BYK Gardner), set to the CIE Lab scale; where L is a measure of the "lightness", a represents the red/green scale, and b the yellow/blue scale. The instrument was calibrated with the standard black and standard white tiles. Each fabric was centered on the aperture at the point of greatest color change due to dye damage. Measurements were taken with the white tile as backing for each cloth. ΔE is calculated as:

$$\Delta E = \sqrt{((L_f - L_i)^2 + (a_f - a_i)^2 + (b_f - b_i)^2)}$$

where the subscript f represents the fabric after application of the PAP containing detergent, and the subscript i represents the untreated fabric.

TABLE I

| ΔE | 2:1 | 3:1 | 4:1 | 5:1 | 6:1 | 7:1 | no amine oxide |
|---|---|---|---|---|---|---|---|
| sulfur black | 7.45 | 6.74 | 5.98 | 4.49 | 8.20 | 13.16 | 20.24 |
| sulfur prune | 16.07 | 12.83 | 19.03 | 8.48 | 14.67 | 18.95 | 17.55 |

Higher values of ΔE indicate greater dye damage from localized contact by the peroxyacid bleach. Absent surfactant, there was extreme dye damage as seen in the average scores of 20.24 and 17.55 for black and prune dyed cloth. Use of PAP with amine oxide significantly reduced dye damage.

The foregoing description and Examples illustrate selected embodiments of the present invention. In light thereof, various modifications will be suggested to one skilled in the art, all of which are within the spirit and purview of this invention.

What is claimed is:

1. A bleach granule comprising 20–100% by weight of an intimate mixture of:

(i) N,N-phthaloylaminoperoxycaproic acid; and (ii) dimethyl $C_{16}$ alkyl amine oxide, the acid and amine oxide being present in a weight ratio of 7:1 to 2:1.

2. A bleach composition comprising:

(a) from 0.5 to 30% by weight of a bleach granule including from 20 to 100% by weight of an intimate mixture of:

(i) N,N-phthaloylaminoperoxycaproic acid (ii) dimethyl $C_{16}$ alkyl amine oxide, the acid and amine oxide being present in a weight ratio from 7:1 to 2:1; and (b) from 1 to 80% by weight of a builder.

* * * * *